US011420320B2

(12) United States Patent
Chang

(10) Patent No.: US 11,420,320 B2
(45) Date of Patent: Aug. 23, 2022

(54) SOCKET HOLDER

(71) Applicant: CHUN NIEN PLASTIC LTD., Taichung (TW)

(72) Inventor: Chi-Tsai Chang, Taichung (TW)

(73) Assignee: CHUN NIEN PLASTIC LTD., Taichung (TW)

( * ) Notice: Subject to any disclaimer, the term of this patent is extended or adjusted under 35 U.S.C. 154(b) by 33 days.

(21) Appl. No.: 17/005,062

(22) Filed: Aug. 27, 2020

(65) Prior Publication Data

US 2021/0060761 A1 Mar. 4, 2021

(30) Foreign Application Priority Data

Sep. 2, 2019 (TW) ..... 108211684

(51) Int. Cl.
*B25H 3/00* (2006.01)

(52) U.S. Cl.
CPC ..... *B25H 3/003* (2013.01)

(58) Field of Classification Search
CPC ..... B23H 3/003; B25H 3/003; B25H 3/00; B25H 3/04; B25H 3/06
USPC ..... 206/349, 378, 377, 376; 211/70.6, 69
See application file for complete search history.

(56) References Cited

U.S. PATENT DOCUMENTS

2005/0218023 A1* 10/2005 Winnard ..... B25H 3/003 206/378
2007/0012587 A1* 1/2007 Wang ..... B25H 3/003 206/379
2011/0089126 A1* 4/2011 Hsieh ..... B25H 3/06 211/70.6
2019/0091842 A1* 3/2019 Chou ..... B25H 3/04
2020/0101590 A1* 4/2020 Winnard ..... B25H 3/003

FOREIGN PATENT DOCUMENTS

TW M555784 U 2/2018

* cited by examiner

*Primary Examiner* — Javier A Pagan
(74) *Attorney, Agent, or Firm* — Muncy, Geissler, Olds & Lowe, P.C.

(57) ABSTRACT

A socket holder is provided, including: an assembling member, including a driving portion which includes a receiving room and a blocking member which is disposed on and radially movable; a base member, including a shaft portion inserted in the receiving room and defining an axis, the shaft portion including a large-diameter portion and small-diameter portion, a diametric size of the large-diameter portion being larger than a diametric size of the small-diameter portion; wherein the driving portion and the base member are relatively movable so that the blocking member is relatively movable between the large-diameter portion and the small-diameter portion, when the large-diameter portion abuts against the blocking member, the blocking member is abutted against and between the shaft portion and the socket; when the small-diameter portion spatially corresponds to the blocking member, the blocking member is radially retractable inwardly between the shaft portion and the socket.

11 Claims, 8 Drawing Sheets

SOCKET HOLDER

BACKGROUND OF THE INVENTION

Field of the Invention

The present invention relates to a socket holder.

Description of the Prior Art

A conventional socket holder, such as disclosed in TW M555784, includes a socket assembling member provided with a blocking structure and an elastic positioning member, and the blocking structure is configured for assembling with a socket. The blocking structure is provided with a receiving room which is radially open. The elastic positioning member is arranged in the receiving room, and the elastic positioning member includes a ball member and an elastic member which is elastically abutted between the bottom of the receiving room and the ball member. The ball member urged by the elastic member can block and secure the socket.

However, with the conventional socket holder, the socket is secured only by the ball member which is retractably urged by the elastic member so that the socket cannot be sufficiently secured and is easy to disengage from the socket holder due to external force.

The present invention is, therefore, arisen to obviate or at least mitigate the above-mentioned disadvantages.

SUMMARY OF THE INVENTION

The main object of the present invention is to provide a socket holder which provides easy and quick engagement and disengagement of a socket.

To achieve the above and other objects, a socket holder is provided, including: an assembling member, including a driving portion configured for assembling of a socket and a blocking member, the driving portion including a receiving room, the blocking member being disposed on and radially movable relative to the driving portion; a base member, including a shaft portion inserted in the receiving room, the shaft portion defining an axis, the shaft portion including a large-diameter portion and small-diameter portion which are transverse to the axis and transverse to each other, a diametric size of the large-diameter portion being larger than a diametric size of the small-diameter portion; wherein the driving portion and the base member are relatively movable so that the blocking member is relatively movable between the large-diameter portion and the small-diameter portion, when the large-diameter portion abuts against the blocking member, the blocking member is abutted against and between the shaft portion and the socket; when the small-diameter portion spatially corresponds to the blocking member, the blocking member is radially retractable inwardly between the shaft portion and the socket.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
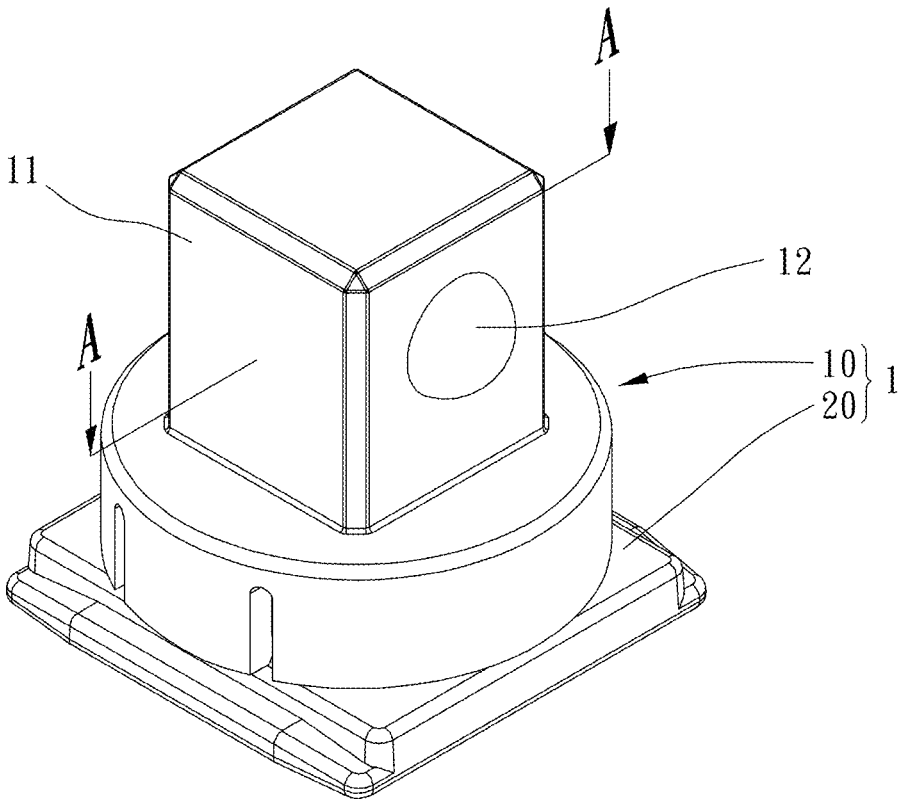
FIG. 1 is a stereogram of a preferable embodiment of the present invention.
Figure 2:
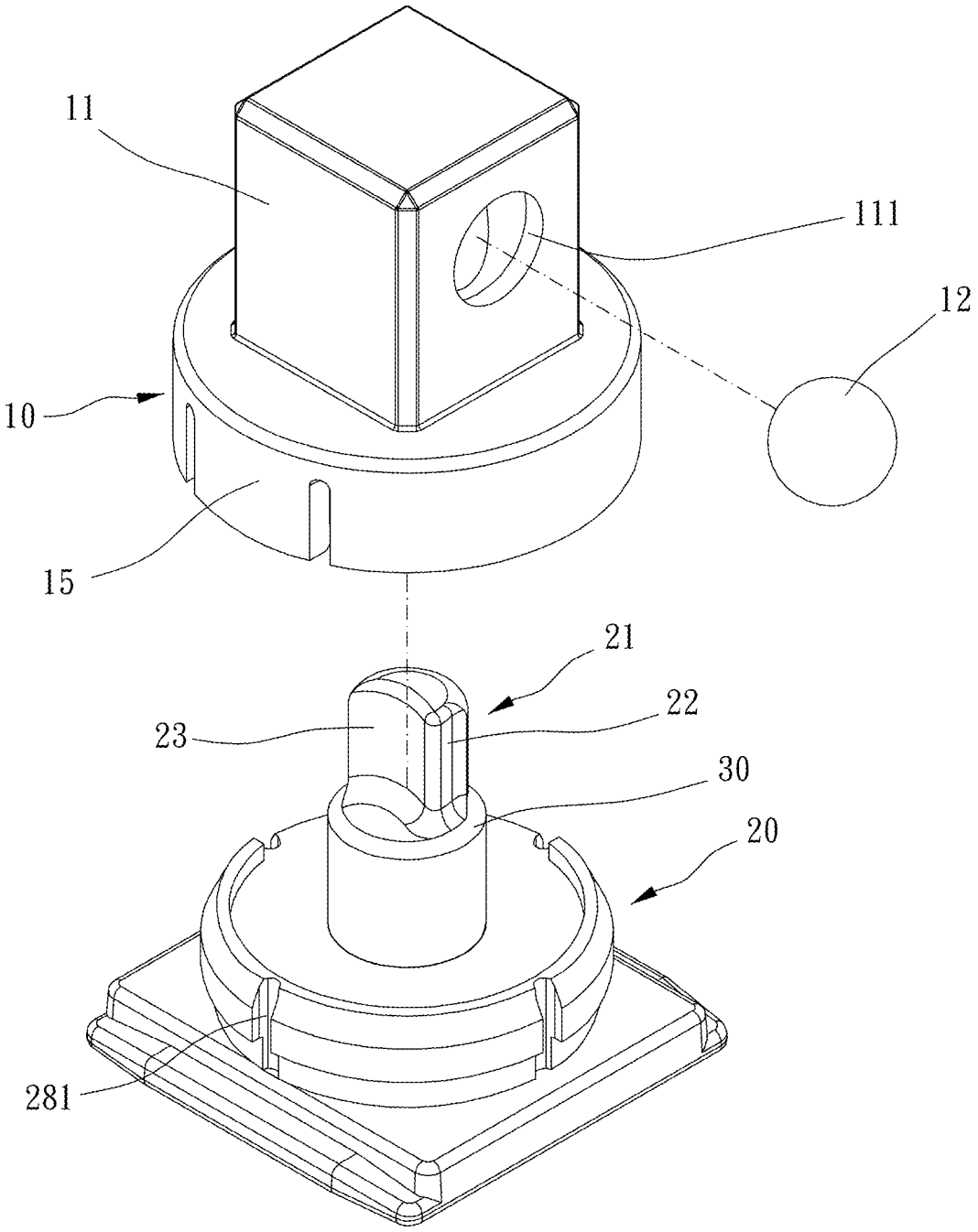
FIG. 2 is a breakdown drawing of a preferable embodiment of the present invention.
Figure 3:
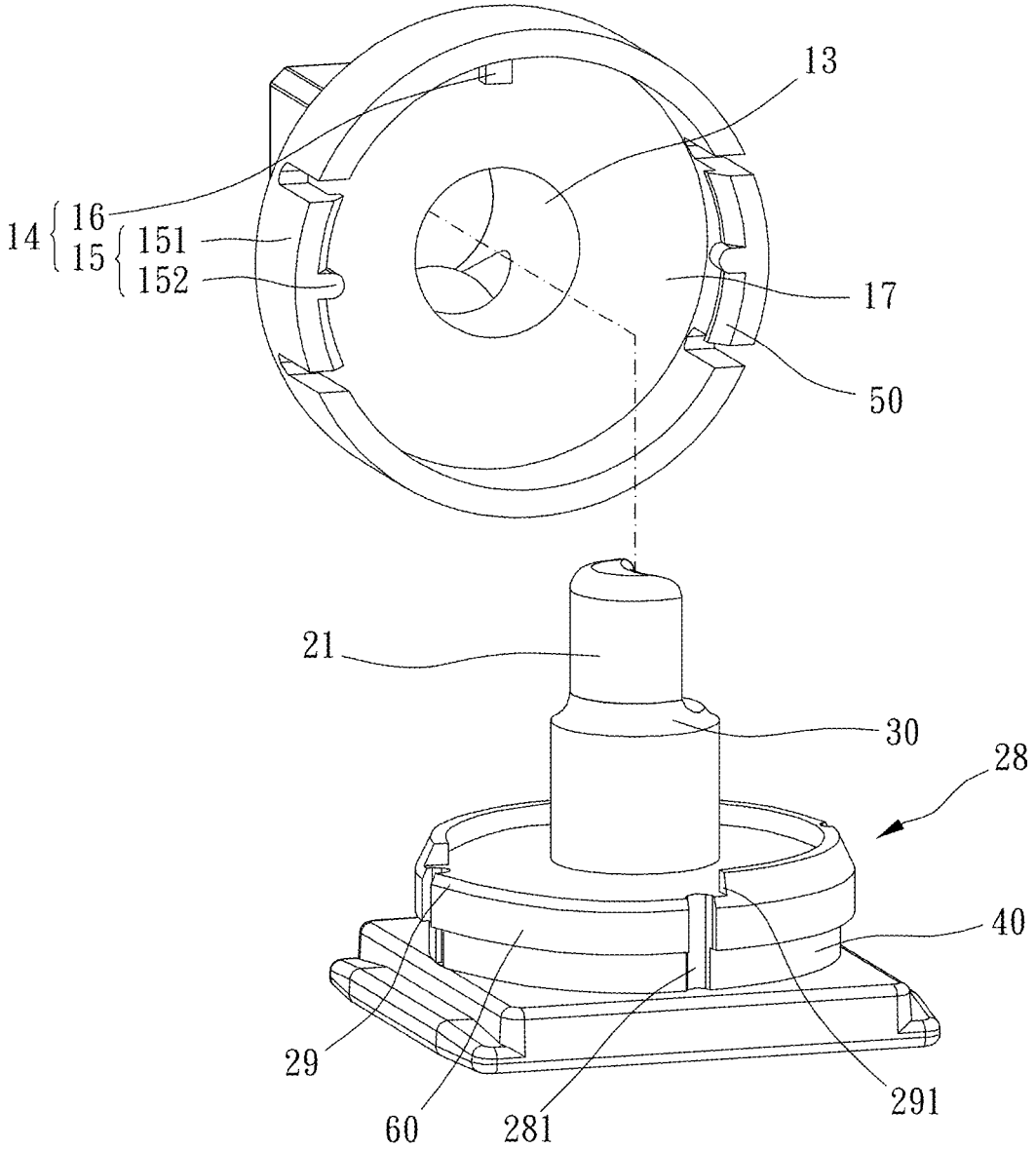
FIG. 3 is another breakdown drawing of a preferable embodiment of the present invention.
Figure 4:
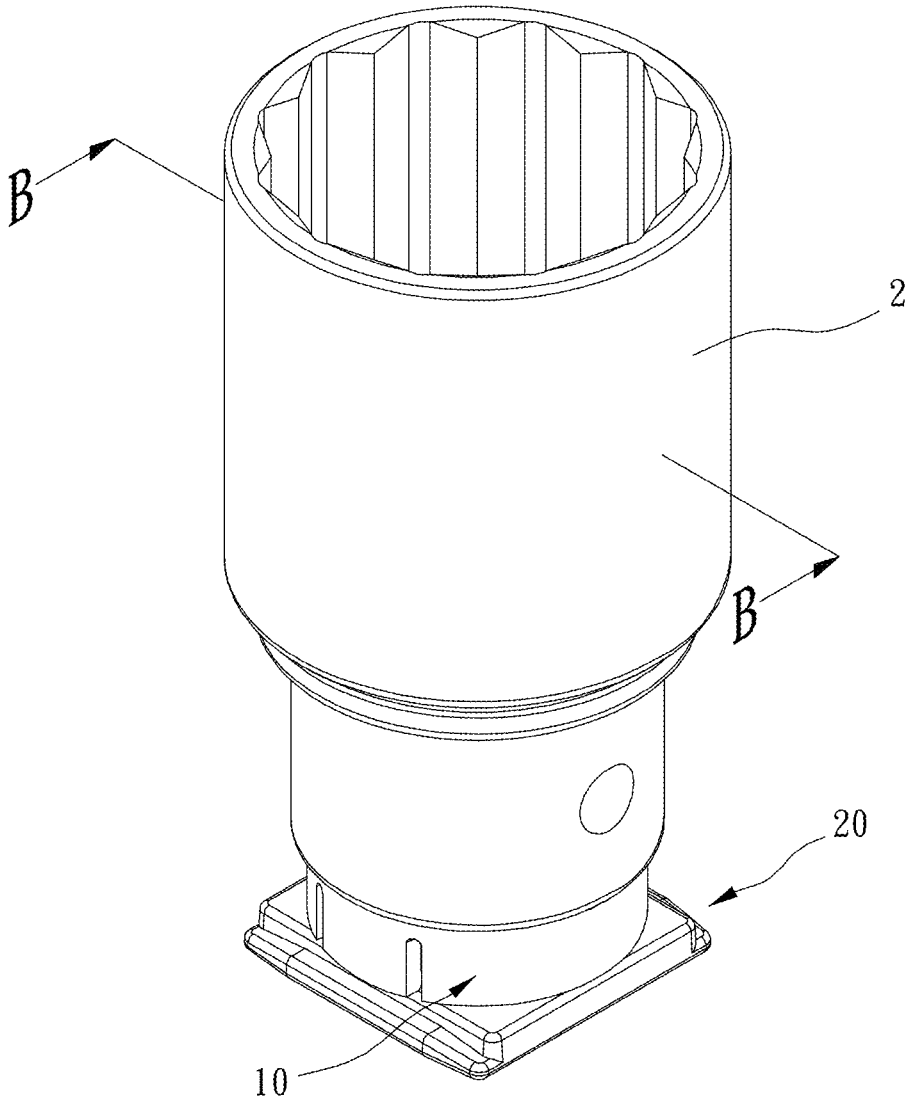
FIG. 4 is a drawing showing an application of a preferable embodiment of the present invention.
Figure 5:
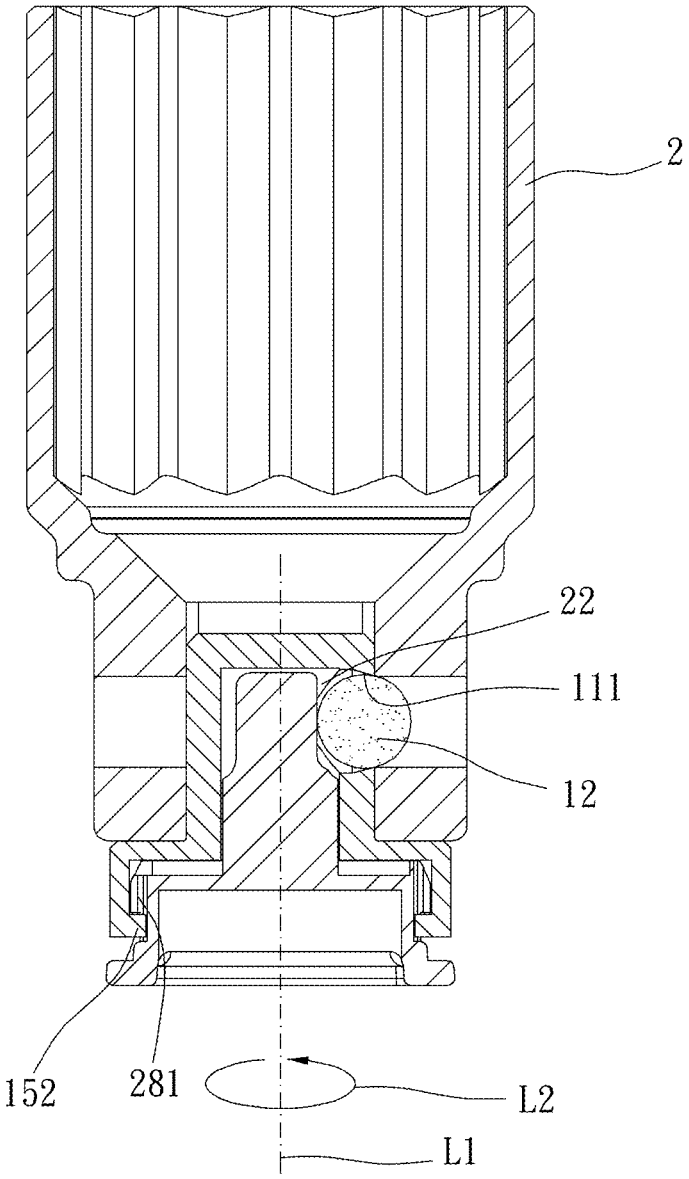
FIG. 5 is a cross-sectional view, taken along line B-B in FIG. 4.
Figure 6:
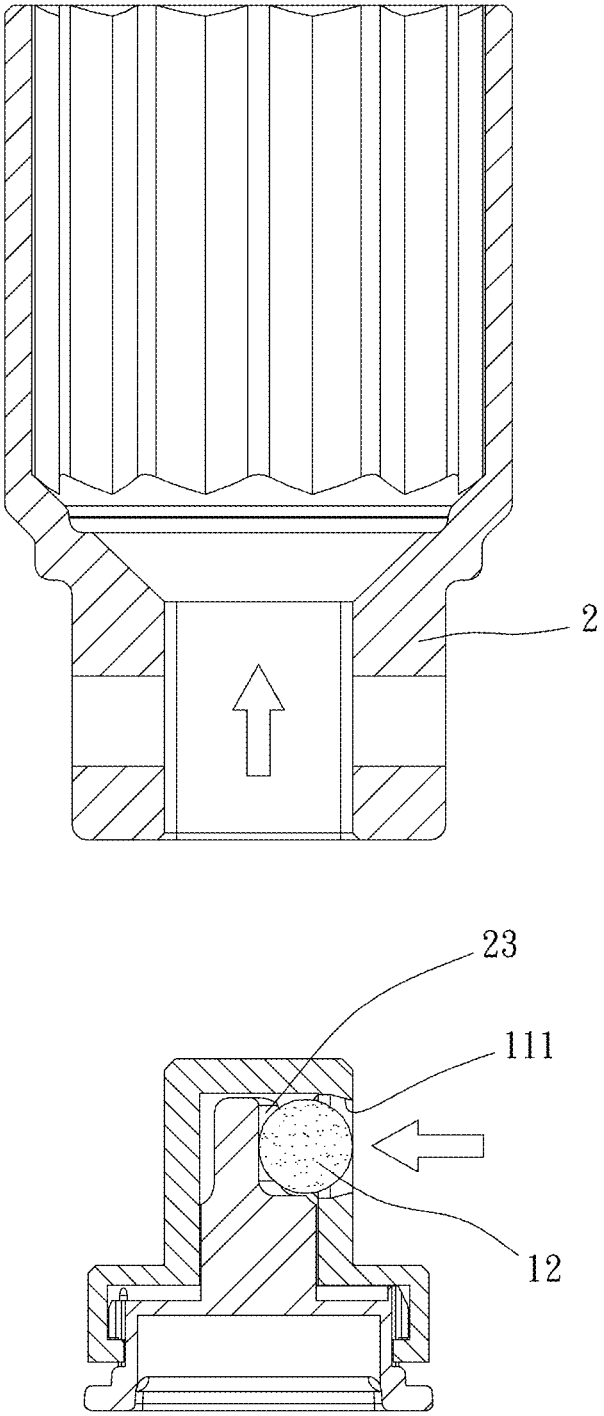
FIG. 6 is a cross-sectional view showing unblocking state of a preferable embodiment of the present invention.
Figure 7:
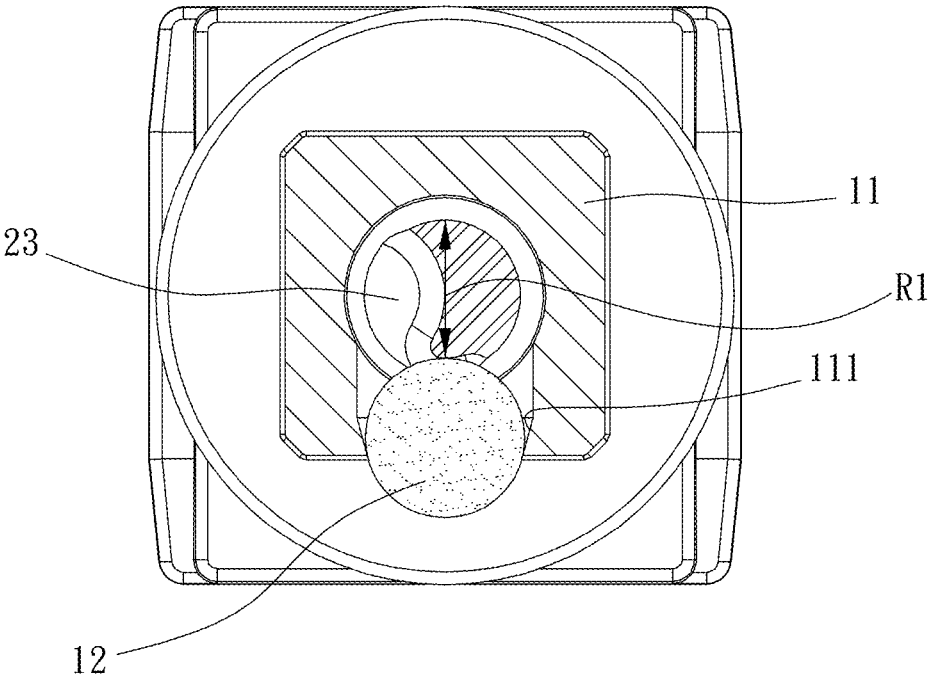
FIG. 7 is a cross-sectional view, taken along line A-A in FIG. 1.
Figure 8:
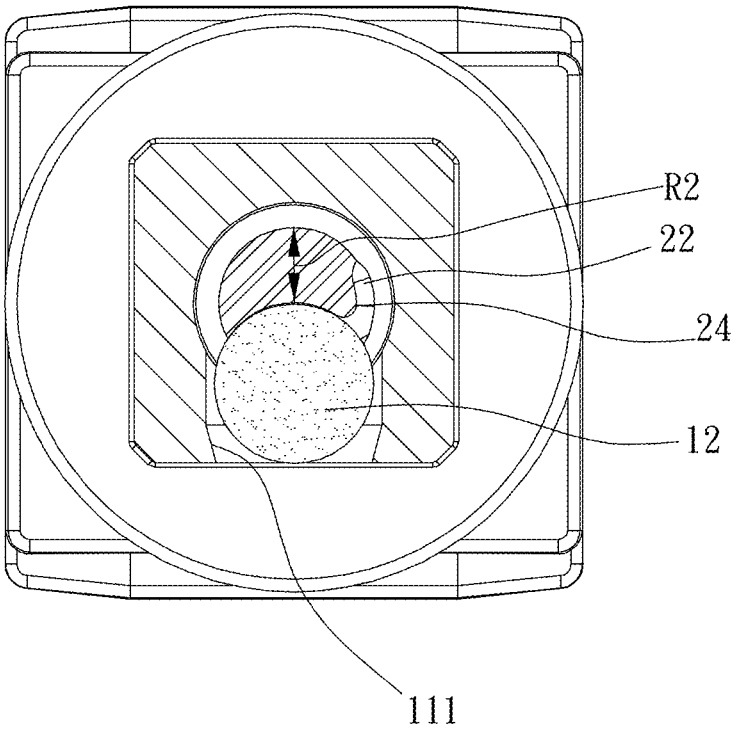
FIG. 8 is another cross-sectional view showing unblocking state of a preferable embodiment of the present invention.
Figure 9:
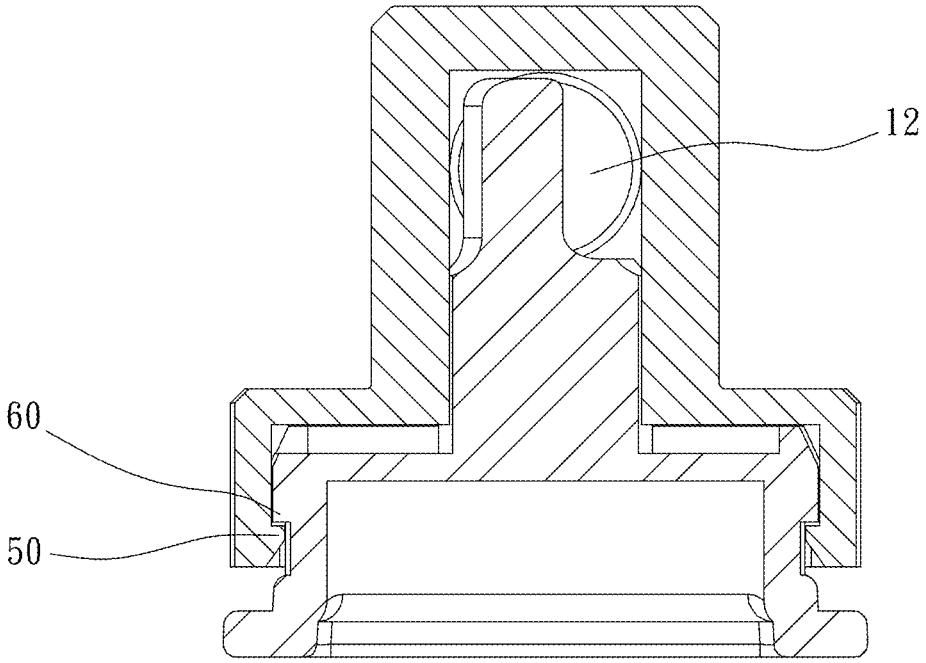
FIG. 9 is a cross-sectional view showing blocking state of a preferable embodiment of the present invention.

Please refer to FIGS. 1 to 9 for a preferable embodiment of the present invention. A socket holder 1 of the present invention includes an assembling member 10 and a base member 20.

The assembling member 10 includes a driving portion 11 configured for assembling of a socket 2 and a blocking member 12. In this embodiment, the blocking member 12 is a ball member; however, the blocking member may be an elastic arm member connected to the assembling member. The driving portion 11 includes a receiving room 13, and the blocking member 12 is disposed on and radially movable relative to the driving portion 11. The base member 20 includes a shaft portion 21 inserted in the receiving room 13, the shaft portion 21 defines an axis L1, and the shaft portion 21 includes a large-diameter portion R1 and a small-diameter portion R2 which are transverse to the axis L1 and transverse to each other, wherein a diametric size of the large-diameter portion R1 is larger than a diametric size of the small-diameter portion R2. The driving portion 11 and the base member 20 are relatively movable so that the blocking member 12 is relatively movable between the large-diameter portion R1 and the small-diameter portion R2. When the large-diameter portion R1 abuts against the blocking member 12, the blocking member 12 is abutted against and between the shaft portion 21 and the socket 2 so that the blocking member 12 is unmovable between the shaft portion 21 and the socket 2; when the small-diameter portion R2 spatially corresponds to the blocking member 12, the blocking member 12 is radially retractable inwardly between the shaft portion 21 and the socket 2. Through relative movement of the assembling member 10 and the base member 20, the blocking member 12 can be urged to be unmovable so as to block the socket 2 or can be released from urging so that the socket 2 is unblocked, thus providing easy and quick locking and unlocking of the socket 2.

The base member 20 defines a circumferential direction L2 around the axis L1, and the large-diameter portion R1 and the small-diameter portion R2 are arranged along the circumferential direction L2. The assembling member 10 and the base member 20 are relatively rotatable about the axis L1 so as to make the large-diameter portion R1 or small-diameter portion R2 correspond to the blocking member 12.

Specifically, the base member 20 further includes a first concave 22 on the large-diameter portion R1 and a second concave 23 on the small-diameter portion R2, the driving portion 11 further includes a receiving hole 111 in communication with the receiving room 13, the receiving hole 111 is a tapered hole, the tapered hole tapers radially inward, the blocking member 12 is movably disposed within the receiving hole 111, and a distance between an apex point of the first concave 22 and the axis is greater than a distance between an apex point of the second concave 23 and the axis L1, wherein the first concave 22 and the second concave 23 can provide low friction and stable support to the blocking member 12. In this embodiment, the base member 20 further includes a corner convex 24 between the large-diameter portion R1 and the small-diameter portion R2. The base member 20 further including an inclined section 30, the inclined section 30 extends radially outward from the assembling member 10 toward the base member 20, and the first concave 22 and the second concave 23 are connected with the inclined section 30. As the blocking member 12 moves between the first concave 22 and the second concave 23, the blocking member 12 contacts the inclined section 30 so that the blocking member 12 can move smoothly. A curvature of the first concave 22 is greater than a curvature of the second concave 23 so that the blocking member 12 can be stably positioned within the second concave 23.

The assembling member 10 further includes a first assembling portion 14, the base member 20 further includes a second assembling portion 28, and the first assembling portion 14 and the second assembling portion 28 are relatively rotatable and axially blockable with each other. Specifically, the first assembling portion 14 including at least one first engaging portion 15 which is radially deformable, wherein the at least one first engaging portion 15 may be made of rubber, elastic plastic or the like. The second assembling portion 28 includes a plurality of second engaging portions 281 extending radially, the plurality of second engaging portions 281 are arranged around the axis L1, and the at least one first engaging portion 15 is disengageably engageable with any of the plurality of second engaging portions 281. In this embodiment, the at least one first engaging portion 15 includes an elastic leg 151 radially deformable relative to the first assembling portion 14 and an assembling structure 152 on the elastic leg 151, one of the assembling structure 152 and each said second engaging portion 281 is a projection, and the other of the assembling structure 152 and each said second engaging portion 281 is groove. Preferably, the at least one first engaging portion 15 includes two first engaging portions 15, the two first engaging portions 15 are located at opposite sides of the assembling member 10; the assembling structure 152 is a projection, the plurality of second engaging portions 281 includes a plurality of grooves which are independently separate from one another. Specifically, each said first engaging portion 15 can pivot so that the projection can be engaged within or disengaged from the groove, for quickly blocking or unblocking the socket.

The assembling member 10 further includes a first limitation structure 16, and the base member 20 further includes a second limitation structure 29. One of the first limitation structure 16 and the second limitation structure 29 is a limitation slot, and the other one of the first limitation structure 16 and the second limitation structure 29 is a limitation protrusion disposed within the limitation slot. The limitation slot extends around the axis L1, the limitation slot includes two limitation walls 291 which are separately arranged and extend axially, and the limitation protrusion is movable between the two limitation walls 29. The base member 20 further includes a column member 40, and an outer diametric size of the column member 40 is larger than an outer diametric size of the shaft portion 21. Each said second engaging portion 281 and the second limitation structure 29 are located at opposite sides of the column member 40, which can limit the relative rotation angle of the assembling member 10 and the base member 20 and quickly aligns engaging members. The limitation slot is at least axially open and radially open so that the limitation protrusion can be quickly mounted into the limitation slot. The assembling member 10 further includes a receiving chamber 17 which is co-axial and communicated with the receiving room 13, and the receiving chamber 17 is disposed around the column member 40.

The elastic leg 151 of each said first engaging portion 15 further includes further a hook portion 50, the second assembling portion 28 includes an annular flange 60, and the hook portion 50 is disengageably engaged with the annular flange 60, which can prevent disengagement of the assembling member 10 from the base member 20 along the axis L1.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket holder, including:

an assembling member, including a driving portion configured for assembling of a socket and a blocking member, the driving portion including a receiving room, the blocking member being disposed on and radially movable relative to the driving portion;

a base member, including a shaft portion inserted in the receiving room, the shaft portion defining an axis, the shaft portion including a large-diameter portion and small-diameter portion which are transverse to the axis and transverse to each other, a diametric size of the large-diameter portion being larger than a diametric size of the small-diameter portion;

wherein the driving portion and the base member are relatively movable so that the blocking member is relatively movable between the large-diameter portion and the small-diameter portion, when the large-diameter portion abuts against the blocking member, the blocking member is abutted against and between the shaft portion and the socket; when the small-diameter portion spatially corresponds to the blocking member, the blocking member is radially retractable inwardly between the shaft portion and the socket;

wherein the base member further includes a first concave on the large-diameter portion and a second concave on the small-diameter portion, the driving portion further includes a receiving hole in communication with the receiving room, the blocking member is movably disposed within the receiving hole, and a distance between an apex point of the first concave and the axis is greater than a distance between an apex point of the second concave and the axis;

wherein a curvature of the first concave is greater than a curvature of the second concave.

2. The socket holder of claim 1, wherein the base member defines a circumferential direction around the axis, and the large-diameter portion and the small-diameter portion are arranged along the circumferential direction.

3. The socket holder of claim 1, wherein the base member further includes a corner convex between the large-diameter portion and the small-diameter portion.

4. The socket holder of claim 1, wherein the base member further includes an inclined section, the inclined section extends radially outward from the assembling member toward the base member, and the first concave and the second concave are connected with the inclined section.

5. The socket holder of claim 1, wherein the assembling member further includes a first assembling portion, the base member further includes a second assembling portion, and the first assembling portion and the second assembling portion are relatively rotatable and axially blockable with each other.

6. The socket holder of claim 5, wherein the first assembling portion includes at least one first engaging portion which is radially deformable, the second assembling portion includes a plurality of second engaging portions extending radially, the plurality of second engaging portions are arranged around the axis, and the at least one first engaging portion is disengageably engageable with any of the plurality of second engaging portions.

7. The socket holder of claim 6, wherein the at least one first engaging portion includes an elastic leg radially deformable relative to the first assembling portion and an assembling structure on the elastic leg, one of the assembling structure and each said second engaging portion is a projection extending radially, and the other of the assembling structure and each said second engaging portion is a groove extending radially.

8. The socket holder of claim 7, wherein the elastic leg of each said first engaging portion further includes a hook portion, the second assembling portion includes an annular flange, and the hook portion is disengageably engaged with the annular flange.

9. The socket holder of claim 6, wherein the assembling member further includes a first limitation structure, the base member further includes a second limitation structure, one of the first limitation structure and the second limitation structure includes a limitation slot, the other one of the first limitation structure and the second limitation structure includes a limitation protrusion disposed within the limitation slot, the limitation slot extends around the axis, the limitation slot includes two limitation walls which are separately arranged and extend axially, the limitation protrusion is movable between the two limitation walls, the base member further includes a column member, an outer diametric size of the column member is larger than an outer diametric size of the shaft portion, and each said second engaging portion and the second limitation structure are located at opposite sides of the column member.

10. The socket holder of claim 1, wherein the receiving hole is a tapered hole.

11. The socket holder of claim 1, wherein the assembling member further includes a first assembling portion, the base member further includes a second assembling portion, and the first assembling portion and the second assembling portion are relatively rotatable and axially blockable with each other; the first assembling portion includes at least one first engaging portion which is radially deformable, the second assembling portion includes a plurality of second engaging portions extending radially, the plurality of second engaging portions are arranged around the axis, and the at least one first engaging portion is disengageably engageable with any of the plurality of second engaging portions; the at least one first engaging portion includes an elastic leg radially deformable relative to the first assembling portion and an assembling structure on the elastic leg, one of the assembling structure and each said second engaging portion is a projection extending radially, and the other of the assembling structure and each said second engaging portion is a groove extending radially; the assembling member further includes a first limitation structure, the base member further includes a second limitation structure, one of the first limitation structure and the second limitation structure is a limitation slot, the other one of the first limitation structure and the second limitation structure is a limitation protrusion disposed within the limitation slot, the limitation slot extends around the axis, the limitation slot includes two limitation walls which are separately arranged and extend axially, the limitation protrusion is movable between the two limitation walls, the base member further includes a column member, an outer diametric size of the column member is larger than an outer diametric size of the shaft portion, and each said second engaging portion and the second limitation structure are located at opposite sides of the column member; the at least one first engaging portion includes two first engaging portions, the two first engaging portions are located at opposite sides of the first assembling portion; the assembling structure is a projection, the plurality of second engaging portions includes a plurality of grooves which are independently separate from one another; the assembling member further includes a receiving chamber which is co-axial and communicated with the receiving room, the receiving chamber is disposed around the column member; and the limitation slot is at least axially open and radially open.

* * * * *